United States Patent [19]

Rottinghaus

[11] Patent Number: 4,848,121

[45] Date of Patent: Jul. 18, 1989

[54] MANUAL HOSE END CRIMPER

[76] Inventor: Robert B. Rottinghaus, 4121 S. Caufield Rd., Jesup, Iowa 50648

[21] Appl. No.: 197,155

[22] Filed: May 23, 1988

[51] Int. Cl.[4] ..... B21D 17/04

[52] U.S. Cl. ..... 72/35; 72/121; 72/126

[58] Field of Search ..... 72/35, 67, 118, 119, 72/120, 121, 123, 124, 126, 211

[56] References Cited

U.S. PATENT DOCUMENTS

| | | | |
|---|---|---|---|
| 1,764,513 | 6/1930 | Kalfus | 72/123 |
| 2,645,141 | 7/1953 | Anthony et al. | 72/121 |
| 2,684,102 | 7/1954 | Clerke | 72/123 |
| 2,813,442 | 11/1957 | Wingate | 72/126 |
| 3,329,000 | 7/1967 | Schwab et al. . | |
| 3,517,539 | 6/1970 | Chirco . | |
| 4,050,286 | 9/1977 | Gasier et al. . | |
| 4,192,171 | 3/1980 | Hamilton . | |
| 4,276,765 | 7/1981 | Yoneda . | |
| 4,339,942 | 7/1982 | Svensson . | |
| 4,389,867 | 6/1983 | Whitlock | 72/126 |
| 4,655,064 | 4/1987 | Hoback | 72/126 |

FOREIGN PATENT DOCUMENTS

| | | | |
|---|---|---|---|
| 846328 | 8/1960 | United Kingdom | 72/121 |

*Primary Examiner*—Lowell A. Larson

*Attorney, Agent, or Firm*—Emrich & Dithmar

[57] ABSTRACT

A manual crimping apparatus for attaching a ferrule to the end of a hose includes a pair of facing die carriers each having a pair of roller dies. The two die carriers may be moved toward and away from each other to establish the inter-die spacing between the die carriers in accordance with the outer diameter of the ferrule. Precise calibration of the inter-die spacing is provided by a plurality of selectively sized gauge blocks in one embodiment or the combination of a gauge stop pin and a plurality of apertures adapted to receive the pin which are spaced in accordance with a range of ferrule sizes. The four roller dies are free to rotate within their respective die carriers, with a first pair of die rollers having parallel axes of rotation and a second pair of die rollers also having parallel axes of rotation. The axes of rotation of the two pairs of roller dies are not aligned with the longitudinal axis of the ferrule such that when the crimping apparatus with its four roller dies tightly engaging the outer surface of the ferrule is rotationally displaced about the ferrule in a plane generally perpendicular to its longitudinal axis, the crimping apparatus moves along the length of the ferrule in a spiral path permitting virtually any length of the ferrule to be crimped in intimate contact with the hose. Apparatus is also disclosed for securely holding the ferrule in a fixed manner during the crimping operation.

25 Claims, 5 Drawing Sheets

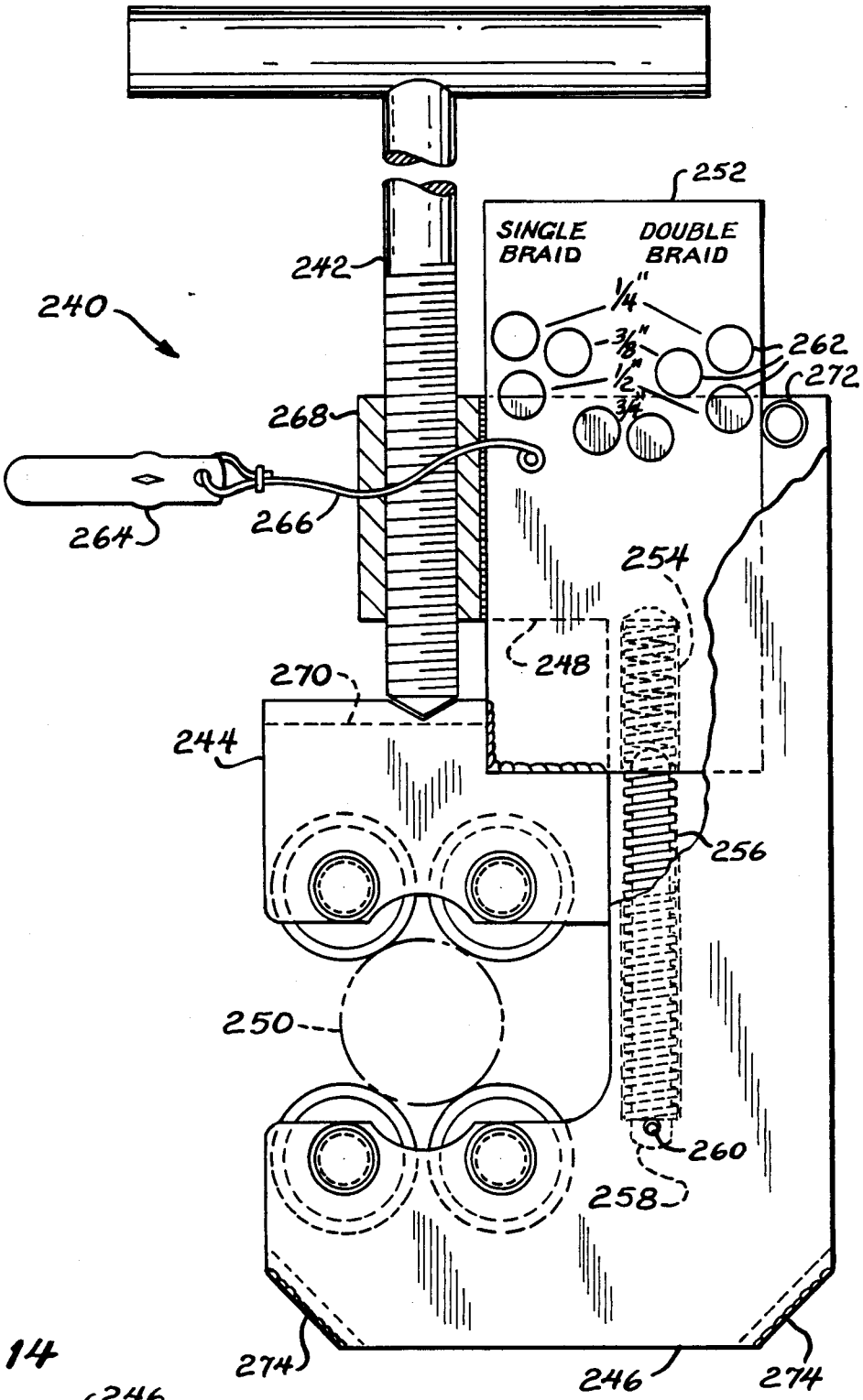
FIG. 13
FIG. 14
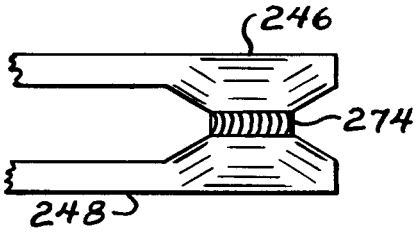

MANUAL HOSE END CRIMPER

BACKGROUND OF THE INVENTION

This invention relates generally to metal working apparatus and is particularly directed to a manually operated crimper for securing a fitting such as a ferrule to the end of a hose.

A ferrule, which is in the form of a rigid, tubular metal fitting, is generally attached to a hose end by a crimping, or swaging, process. During crimping, or swaging, the ferrule is mechanically compressed inwardly around its periphery so as to securely engage the outer surface of the hose. In this manner, a leak-free coupling is formed between the hose and ferrule for use in a closed, pressurized hydraulic system. With one end of the ferrule crimped to the end of the hose, its other end is frequently provided with threads to permit the hydraulic hose to be coupled to a hydraulically actuated and driven device. Such closed hydraulic systems are commonly used in agricultural applications such as in tractors, combines, etc.

Most prior art crimping arrangements are of the permanent, fixed installation type and are not adapted for use on-site or in the field. These fixed-type crimping arrangements also tend to be somewhat complex and expensive. Portable crimping devices are generally manually operated and are capable of use at remote sites to repair leaking hydraulic connections. Manually operated crimpers typically require a vise for maintaining the ferrule in a fixed position while the crimper engages the ferrule about its periphery and forms a narrow area of compression on the ferrule. It is the compressed area of the ferrule which engages the hose in a sealed manner.

The narrow crimped band around the ferrule engages the hose around its periphery over a short length of the ferrule and thus affords only limited protection against fluid leakage. In addition, because the ferrule compression area is of a very limited width, deformation of the ferrule during crimping frequently causes structural fatigue and cracking of the ferrule resulting in its eventual failure. Other manually operated hose end connecting tools require a special soft metal, or aluminum, ferrule because of the limited compressive force which they are capable of exerting. These types of ferrules are generally more expensive and difficult to obtain than conventional ferrules comprised of more commonly used metals and alloys.

The present invention is intended to overcome the aforementioned limitations of the prior art by providing a low cost, manually operated, portable hose end crimping device for securely affixing a ferrule to the end of a hose. The manual hose end crimper provides an extended ferrule compression area which is formed in a step-wise, incremental diameter reducing manner which subjects the ferrule to limited stress and reduces the likelihood of structural fatigue, cracking and ferrule destruction. The manual hose end crimper is adapted for use with ferrules having a wide range of diameters, with the crimper easily and precisely adjusted to a given ferrule size.

OBJECTS AND SUMMARY OF THE INVENTION

Accordingly, it is an object of the present invention to provide an improved apparatus for crimping a rigid, tubular fitting such as a ferrule on the end of a hose.

It is another object of the present invention to provide a manually operated and adjusted hose end crimping device which is capable of accommodating a wide range of hose end fitting diameters.

Yet another object of the present invention is to provide crimping engagement for a ferrule on the end of a hose which is substantially greater than the crimping engagement currently available.

A further object of the present invention is to provide an arrangement for securely attaching a ferrule on the end of a hose which affords crimping engagement of the ferrule with the hose along substantially the entire length of the ferrule.

A still further object of the present invention is to provide apparatus for crimping a ferrule on a hose end in a tight fitting manner, wherein the extent, or strength, of crimping engagement may be selected over a wide, virtually continuous range of values.

Still another object of the present invention is to provide the combination of a ferrule mounting arrangement and a ferrule crimping device which is manually operated, inexpensive, portable, adjustable over a wide range of ferrule sizes, and allows for continuous crimping of a ferrule over substantially its entire length.

Another object of the present invention is to provide an apparatus and method for crimping a ferrule on the end of a hose which minimizes the possibility of damaging the ferrule.

It is still another object of the present invention to provide an apparatus for engaging and swaging a ferrule onto a hose end in a spiral tracking manner so that there is a continuous crimp between the ferrule and the hose end over a given length of the ferrule which may be established as desired.

The present invention contemplates a manually operated apparatus for crimping a ferrule onto the end of a hose. The manually operated crimping apparatus includes first and second roller means; first and second carrier means for engaging and supporting the first and second roller means, respectively, in spaced relation; and manual control means coupled to the first and second carrier means for adjusting the spacing between the first and second carrier means and for positioning the first and second roller means in tight fitting contact with a ferrule disposed therebetween. The first and second roller means are oriented at an angle relative to a plane perpendicular to a longitudinal axis of the ferrule such that rotation of the crimping apparatus about the ferrule in a direction generally perpendicular to its longitudinal axis causes the roller means to follow a spiral path along the length of the ferrule in crimping the ferrule to the hose end.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 13 is a planar view shown partially cutaway and partially in phantom of yet another embodiment of a manual crimping apparatus in accordance with the present invention; and FIG. 14 is an end-on view of a lower corner of the manual crimping apparatus of FIG. 13 illustrating details of its construction.

DETAILED DESCRIPTION OF THE PREFERRED EMBODIMENTS

Figure 1:
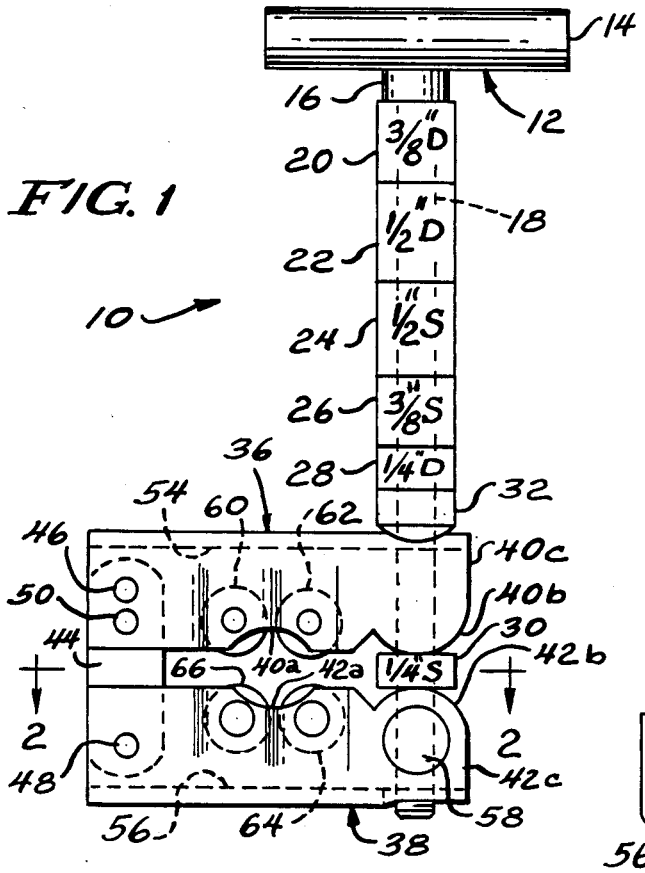
FIG. 1 is a planar view shown partially in phantom of a manual hose end crimper in accordance with the present invention.

Referring to FIG. 1, there is shown a planar view partially in phantom of a manual hose end crimper 10 in accordance with the principles of the present invention. The manual hose end crimper 10 includes a "T"-shaped draw bolt 12 coupled to the combination of first and second engaging members 36 and 38. The "T"-shaped draw bolt 12 includes a gripping portion, or handle, 14 and a threaded shaft 18 which are oriented generally transversely to one another. Disposed on the proximal end of the threaded shaft 18 and in contact with the gripping portion 14 of the "T"-shaped draw bolt 12 is a spacer washer 16. The threaded shaft 18 is inserted through a plurality of bushing shaped gauge blocks 20, 22, 24, 26 and 28 as well as through a pivoting thrust washer 32. The threaded shaft 18 is further inserted through yet another gauge block 30 disposed between the first and second engaging members 36, 38, with the distal end of the threaded shaft inserted through and engaging a threaded pivotal alignment bushing 58 coupled to the second engaging member. The "T"-shaped draw bolt 12 is pivotally displaceable relative to the first engaging member 36 by means of the pivoting thrust washer 32. Similarly, the "T"-shaped draw bolt 12 is pivotally displaceable relative to the second engaging member 38 by means of the alignment bushing 58 which is free to pivot within the second engaging member. Each of the gauge blocks 20, 22, 24, 26 and 28 are respectively used with $\frac{3}{8}''$ double (D) gauge, $\frac{1}{2}''$ D gauge, $\frac{1}{2}''$ single (S) gauge, $\frac{3}{8}''$ S gauge, and $\frac{1}{4}''$ D gauge hose as further described below. Gauge block 30 is disposed between and in contact with the first and second engaging members 36, 38 and provides proper spacing therebetween for a $\frac{1}{4}''$ single gauge hose as described below. Finally, each of the gauge blocks is labeled with the size of the ferrule with which it is intended for use.

The right hand portions of the first and second engaging members 36, 38 as viewed in FIG. 1 are thus displaced toward one another and in intimate contact with the $\frac{1}{4}''$ S gauge block 30 by rotationally displacing the "T"-shaped draw bolt 12. Rotational displacement of the "T"-shaped draw bolt 12 in a first direction thus draws the pivoting thrust washer 32 and the alignment bushing 58 toward one another forcing a curved portion 40*b* of the first engaging member 36 in intimate contact with the $\frac{1}{4}''$ S gauge block and a corresponding curved portion 42*b* of the second engaging member 38 also in intimate contact with the $\frac{1}{4}''$ gauge block. The respective curved portions 40*b* and 42*b* of the first and second engaging members 36 and 38 as well as the curved portion of the pivoting thrust washer 32 allow the draw bolt 12 to pivot relative to the first and second engaging members to accommodate the positioning of gauge blocks having different thicknesses between the engaging members. The thickness of the gauge block positioned between and in contact with the first and second engaging members 36, 38 is determined by the outer diameter of the ferrule to be crimped.

The left hand portions of the first and second engaging members 36, 38 as shown in FIG. 1 are coupled together by means of the combination of a connecting bar 44 and first and second connecting pins 46 and 48. The first connecting pin 46 is inserted through a pair of spaced apertures within the first engaging member 36, while the second connecting pin 48 is inserted through a pair of spaced apertures in the second engaging member 38. In addition, the first connecting pin 46 is inserted through an aperture at one end of the elongated, linear connecting bar 44, while the second connecting pin 48 is inserted through a second aperture at the other end of the connecting bar. The first and second connecting pins 46, 48 provide pivoting displacement between each of the first and second engaging members 36, 38 and the connecting bar 44. A second set of apertures 50 is provided for in the first engaging member 36 to allow for increased separation between the first and second engaging members 36, 38 when coupled together by the connecting bar 44. Increased displacement between the engaging members is required for larger diameter ferrules as described below.

Figure 5:
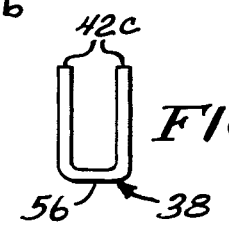
FIG. 5 is an end-on view of the lower roller die carrier portion of the manual hose end crimper illustrated in FIG. 1.

Each of the first and second engaging members 36, 38 is preferably in the form of an elongated, U-shaped structure such as shown in the end view of the second engaging member 38 in FIG. 5. Thus, the second engaging member 38 includes a pair of spaced side walls 43*c* coupled together at adjacent ends and along the length thereof by an end wall 56. Similarly, the first engaging member 36 includes a pair of spaced side walls 40*c* joined together along their respective upper edges by an end wall 54. The U-shaped structural configuration of the first and second engaging members 36, 38 is preferably comprised of a unitary piece of forged metal such as steel.

Each of the first and second engaging members 36, 38 further includes two additional pairs of facing apertures therein. Disposed within each pair of spaced apertures in each of the engaging members is a bearing pin on which is rotationally disposed a respective roller die. Thus, first and second roller dies 60, 62 are coupled to and positioned within the first engaging member 36, while third and fourth roller dies 64, 66 are positioned within and coupled to the second engaging member 38. Each of the bearing pins permits the roller die to which it is coupled to be rotationally displaced within an engaging member. The first and second engaging members 36, 38 also include respective facing recessed portions 40*a* and 42*a* disposed immediately adjacent to and between respective pairs of roller dies. Thus, the first and second roller dies 60, 62 are partially positioned within the recessed portion 40*a* of the first engaging member 36. Similarly, the third and fourth roller dies 64, 66 are partially positioned within and extend beyond the recessed portion 42*a* of the second engaging member 38. Each of the roller dies, as shown for the case of the first roller die 60 in FIG. 3, includes an aperture 60*a* through which a respective bearing pin is inserted. Each of the roller dies further includes a pair of facing tapered edges shown as elements 60*b* in FIGS. 3 and 4 for the case of the first roller die 60. Finally, each of the roller dies also includes a spiral groove on its outer peripheral surface shown as element 60*c* for the case of the first roller die 60 illustrated in FIG. 4.

The manual crimper 10 operates in the following manner to securely engage a ferrule for the purpose of crimping the ferrule onto the end of a hose. With the outer diameter of the ferrule known, the corresponding gauge block is positioned about the threaded shaft 18 of the "T"-shaped draw bolt 12 and is spaced between the first and second engaging members 36, 38 and in contact with their respective facing curved portions. This may be accomplished by removing the "T"-shaped draw bolt 12 from the threaded pivotal alignment bushing 58 and withdrawing it from the pivoting thrust washer 32. The appropriate gauge block as determined by the outer diameter of the selected ferrule is then slid off the threaded shaft 18 and removed from the "T"-shaped draw bolt 12. With the desired gauge block disposed between the first and second engaging members 36, 38 and in alignment with the alignment bushing 58, the threaded shaft 18 is then threaded through the alignment bushing so as to draw the first and second engaging members 36, 38 toward each other and in intimate contact with the gauge block disposed therebetween, as shown for the case of the ¼" S gauge block 30 in FIG. 1. Each of the first and second engaging members 36, 38 is free to rotate about a respective end of the connecting bar 44 by means of one of the respective connecting pins 46 and 48. Before tightening the "T"-shaped draw bolt 12 and drawing the first and second engaging members 36, 38 toward each other, the ferrule to be crimped is positioned between the four roller dies 60, 62, 64 and 66. With the ferrule disposed in the space defined by the four aforementioned roller dies, the "T"-shaped draw bolt 12 is then rotationally displaced so as to draw the first and second engaging members 36, 38 toward each other and in intimate contact with the gauge block 30. The thickness of the gauge block 30 ensures that the spacing between the first and second roller dies 60, 62 and the third and fourth roller dies 64, 66 is such that the ferrule disposed therebetween is tightly crimped by the four aforementioned roller dies as the manual crimper 10 is rotationally displaced about the ferrule. For large diameter ferrules, the first connecting pin 46 may be removed from the first pair of aligned apertures in the first engaging member 36 and inserted through a second pair of apertures 50 within the first engaging member to permit a larger sized ferrule to be positioned between the aforementioned four roller dies. A corresponding larger gauge block would then be positioned between the respective convex portions 40*b* and 42*b* of the first and second engaging members 36 and 38.

Figure 2:
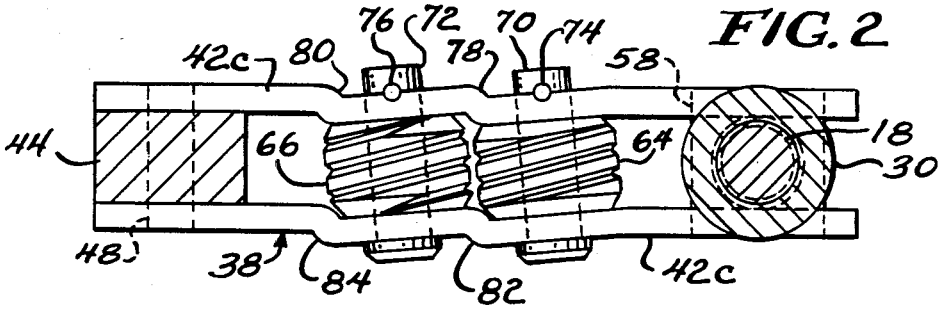
FIG. 2 is a sectional view of the manual hose end crimper illustrated in FIG. 1 taken along sight line 2—2 therein.

Referring to FIG. 2, there is shown a sectional view of the manual crimper illustrated in FIG. 1 taken along sight line 2—2 therein. The sectional view of FIG. 2 illustrates the details of the manner in which the pair of third and fourth roller dies are positioned within and coupled to the second engaging member 38. A similar arrangement is provided for in mounting the first and second roller dies 60, 62 in the first engaging member 36. As shown in FIG. 2, the second connecting pin 48 is inserted through facing apertures in the side walls of the second engaging member 38 as well as through the connecting bar 44. At the other end of the second engaging member the threaded pivotal alignment bushing 58 shown in dotted line form is also inserted through facing apertures in the side portions of the second engaging member. Inserted within and threadably engaging the gauge block 30 is the threaded shaft 18.

A bearing pin 70 is inserted through spaced apertures in the facing side portions of the second engaging member 38 as well as through an aperture in the third roller die 64. Similarly, another bearing pin 72 is inserted through spaced apertures in the facing side portions of the second engaging member 38 as well as through the aperture in the fourth roller die 66. As previously described with respect to the first roller die 60 and as illustrated in FIG. 2, each of the third and fourth roller dies 64, 66 is provided with a similar spiral groove in its outer, peripheral surface. Each of the third and fourth roller dies 64, 66 further includes a tapered edge on facing outer lateral portions thereof. Each of the bearing pins 70, 72 includes an enlarged head end as well as an aperture adjacent to the opposite end thereof. Retaining pin 74 is inserted through the aperture in bearing pin 70, while retaining pin 76 is inserted through the aperture in bearing pin 72. Each of these retaining pins is preferably inserted in a respective slot on the outer surface of the second engaging member 38 in order to maintain it securely in position and inserted through its associated bearing pin. Thus, retaining pins 74 and 76 respectively maintain bearing pins 70 and 72 securely in position within the second engaging member 38.

Figure 3:
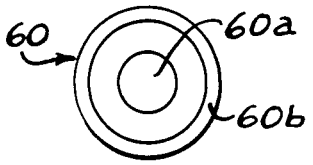
FIG. 3 is a planar view of a roller die used in the manual hose end crimper of the present invention.
Figure 4:
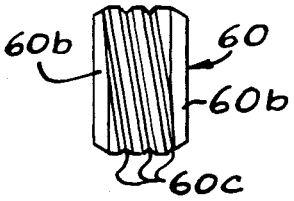
FIG. 4 is an end-on view of the manual hose end crimper roller die illustrated in FIG. 3.

As shown in FIG. 2, as well as in the shaded portions of the manual crimper 10 shown in FIG. 1 and in accordance with the present invention, each of the roller dies is oriented at an angle relative to the lengthwise dimensions of the first and second engaging members 36, 38. Thus, the upper side wall of the second engaging member 38 as shown in FIG. 3 includes first and second angled portions 78, 80 while the lower side wall 42*c* includes third and fourth angled portions 82 and 84. Each pair of angled portions in the side walls of the second engaging member 38 provides each of the roller dies 64 and 66 with an axis of rotation which is not perpendicular to a plane defined by the first and second engaging members 36, 38 and the threaded shaft 18 of the "T"-shaped draw bolt 12. Thus, with a ferrule (not shown) inserted between and engaged by each of the four roller dies 60, 62, 64 and 66, rotation of the manual crimper 10 about the ferrule in a direction generally perpendicular to its longitudinal axis will cause the manual crimper to track along the outer surface of the ferrule in a spiral rather than a circular path. In this manner, the manual crimper 10 of the present invention crimps the surface of the ferrule along the length thereof. An extended ferrule compression area may thus be crimped onto a hose for more secure engagement between the ferrule and hose end.

It should be noted that the first and second roller dies 60, 62 are provided with spaced, parallel axes of rotation, while the third and fourth roller dies 64, 66 are also provided with spaced, parallel axes of rotation. It should also be noted that the axes of rotation of the first and second rollers 60, 62 are not aligned with and parallel to the axes of rotation of the third and fourth roller dies 64, 66, as described below. It is the angled orientation of each of the four aforementioned roller dies relative to the longitudinal axis of a ferrule disposed between and in contact with these roller dies which permits the manual crimper 10 of the present invention to crimp the ferrule along a spiral path extending along the length of the ferrule. The spiral grooves in each of the four aforementioned roller dies further assists in the spiral tracking of the manual crimper 10 as it is rotated about a ferrule positioned therein and engaged thereby. The extent of engagement between the ferrule and hose end as established by the length of the ferrule compression area may be selected as desired by the operator of the hose end crimper. Thus, where more secure fittings are required, a larger length of the ferrule may be securely crimped in intimate contact with the hose end. In some applications, it may be desirable to crimp the ferrule along its entire length in order to provide a high degree of engagement between the ferrule and hose end.

Figure 7:
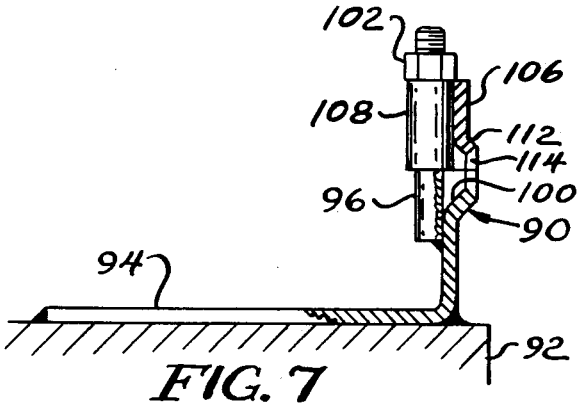
FIG. 7 is a sectional view of the ferrule retainer illustrated in FIG. 6 taken along sight line 7—7 therein.
Figure 6:
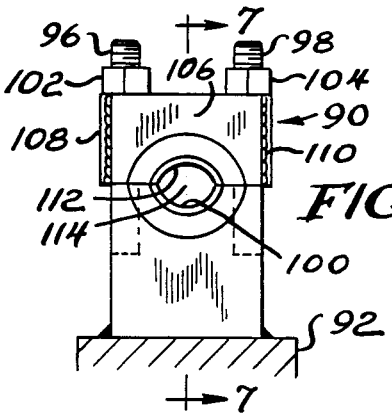
FIG. 6 is an end-on view of a ferrule retainer for use with the manual hose end crimper of the present invention.
Figure 8:
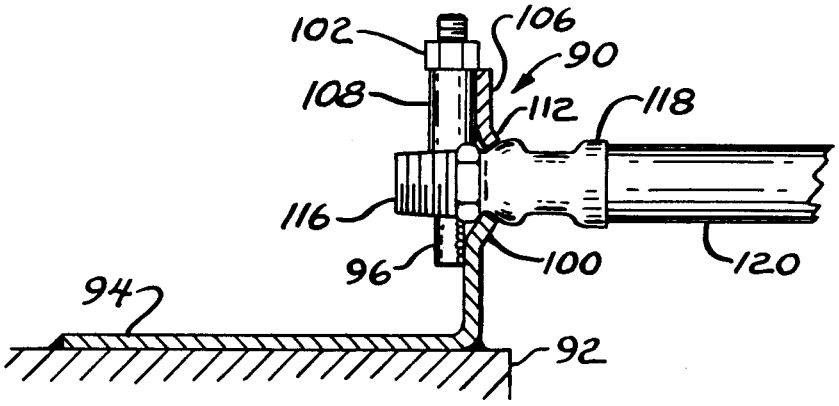
FIG. 8 is a lateral view shown partially in section of the retainer mechanism of FIGS. 6 and 7 illustrating the manner in which the retainer mechanism engages and supports a ferrule during crimping.

Referring to FIGS. 6 and 7, there are respectively shown end-on and side views of a hose end retainer 90 for use with the manual crimper of the present invention. The hose end retainer 90 includes an angle 94 securely attached to a support structure 92 by conventional means such as weldments. Coupled to the angle 94 are first and second threaded pins 96 and 98. The first and second threaded pins 96, 98 are positioned adjacent to respective opposed lateral edges of the angle 94 and extend upward and beyond the angle. An upper, center edge of the angle 94 is provided with a first concave lip 100 which extends outward and upward from the angle as shown in FIG. 7. Hose end retainer 90 further includes a plate 106 to which are securely attached in spaced relation first and second mounting sleeves 108 and 110. As in the case of the first and second threaded pins 96, 98, the first and second mounting sleeves 108, 110 are attached to plate 106 by conventional means such as weldments. The first and second mounting sleeves 108, 110 are respectively adapted for positioning over and receiving the first and second threaded pins 96, 98. A center portion of the lower edge of plate 106 is provided with a second concave lip 112. With the first and second threaded pins 96, 98 respectively inserted in the first and second mounting sleeves 108, 110, the first and second concave lips 100, 112 define a generally oval, or circular, aperture in the hose end retainer 90, which is adapted to receive and engage a ferrule 118 positioned therein as shown in FIG. 8, which is a lateral sectional view illustrating the manner in which the retainer engages and retains a rigid, tubular ferrule. The first and second concave lips 100, 112 extend outward from the plane of the ferrule engaging portion of the hose end retainer 90 to facilitate secure engagement and retention of a ferrule 118 by the retainer. The size of the aperture 114 defined by the first and second concave lips 100, 112 is determined by the size of the ferrule. With each of the aforementioned lips in intimate contact with the ferrule disposed therebetween, first and second nuts 102, 104 positioned on the first and second threaded pins 96, 98 are tightened downwardly on the first and second mounting sleeves 108, 112 in displacing the plate 106 downward and forcing the first and second concave lips 100, 112 in intimate contact with the outer periphery of a ferrule 118 disposed within the aperture 114.

As shown in FIG. 8, a hose 120 is inserted in one end of the ferrule 118 while a threaded fitting 116 is attached to the other end of the ferrule. The ferrule 118 is crimped on one end thereof to ensure that it is securely coupled to and engages the threaded fitting 116. The ferrule 118 is then positioned between the first concave lip 100 of the angle 94 and the second concave lip 112 of the plate 106. The first and second nuts 102, 104, which may also be in the form of wing nuts, are then tightened on the first and second threaded pins 96, 98 so as to engage and displace downward the combination of the first and second mounting sleeves 108, 110 and the plate 106. In this manner, the ferrule 118 is securely engaged about a substantial portion of its outer periphery by the first and second concave lips 100, 112. With the ferrule 118 thus maintained in a fixed position and orientation by the hose end retainer 90, the ferrule may then be crimped over the end of the hose 120 to ensure secure engagement therebetween. The distal end of the ferrule 118 is typically bell-shaped, or bevelled, to reduce the possibility of cutting the hose 120 during operation.

Figures 9, 10, 11:
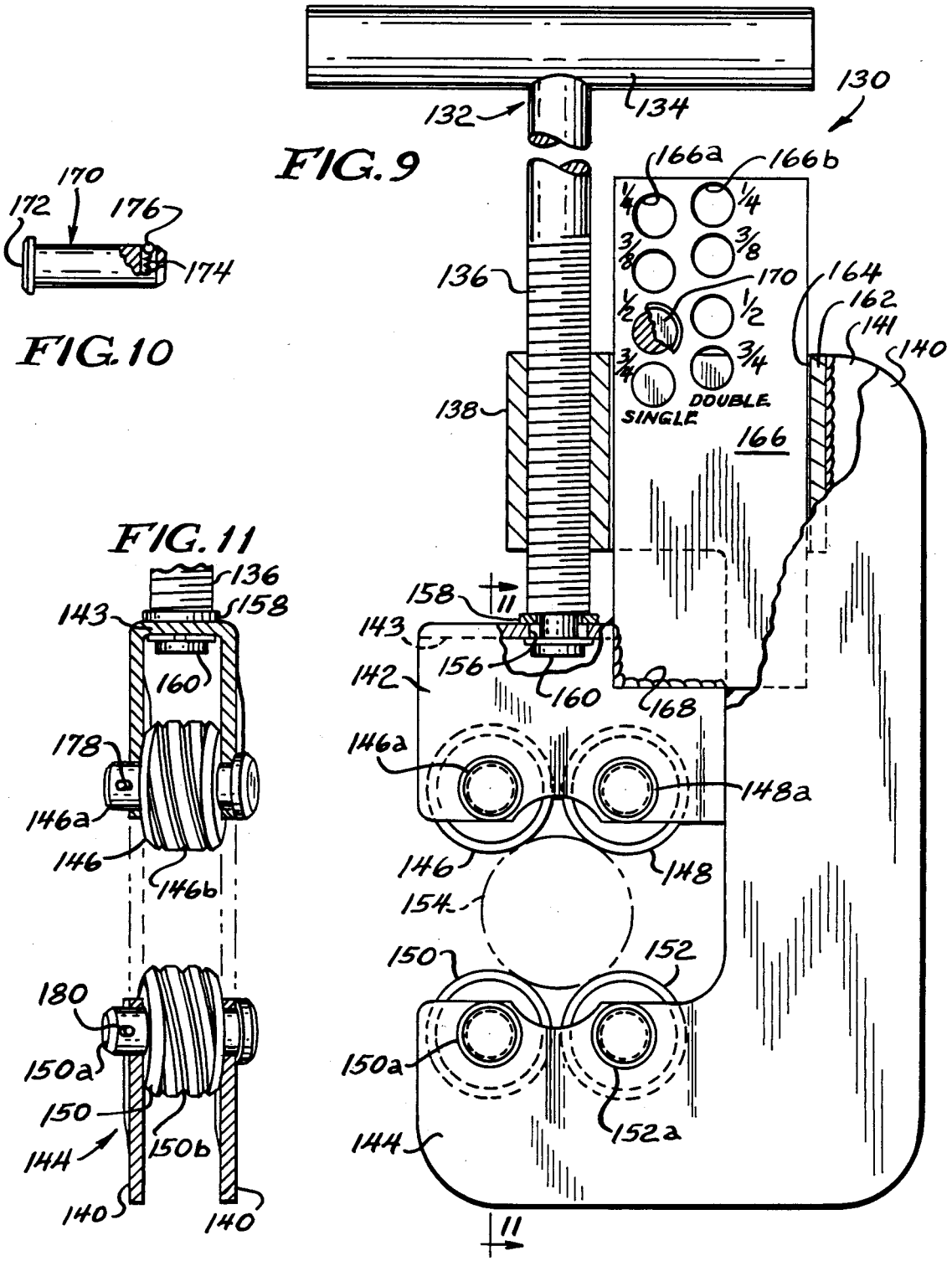
FIG. 9 is a partially cutaway planar view shown also partially in phantom of another embodiment of a manual hose end crimper in accordance with the present invention.
FIG. 10 is a partially cutaway side view of a gauge pin for use in the manual hose end crimper of FIG. 9.
FIG. 11 is a sectional view of the manual hose end crimper of FIG. 9 taken along sight line 11—11 therein.

Referring to FIG. 9, there is shown another embodiment of a manual crimper 130 in accordance with the present invention. The manual crimper as shown in FIG. 9 includes a pair of spaced C-shaped plates 140 and 141. Each of the C-shaped plates 140 is generally planar, with the plates arranged in spaced, parallel alignment as shown in FIG. 11, which is a sectional view of the manual crimper 130 illustrated in FIG. 9 taken along sight line 11—11 therein. The upper ends of each of the C-shaped plates 140 and 141 are coupled together by means of an elongated hex nut 138 which is attached to each of the C-shaped plates and extends therebetween. An elongated, flat guide sleeve 162 is also coupled to the inner surfaces of each of the C-shaped plates 140 and 141 by conventional means such as a weldment. The space between and defined by the C-shaped plates 140 and 141, hex nut 138, and guide sleeve 162 forms a slot 164.

Disposed within and engaging the hex nut 138 is the threaded shaft 136 of a "T"-shaped draw bolt 132. The "T"-shaped draw bolt 132 further includes a gripping portion, or handle, 134. Rotation of the "T"-shaped draw bolt 132 within the hex nut 138 displaces the draw bolt as well as a roller die carrier 142 coupled to the lower end thereof either upward or downward depending upon the direction of rotation. The lower end of the threaded shaft 136 is inserted through an aperture 156 within an upper, end wall 143 of the roller die carrier 142. A thrust washer 158 is disposed between the threaded shaft 136 and the end wall 143 of the roller die carrier 142 to facilitate rotational displacement of the "T"-shaped draw bolt 132 within the roller die carrier. A snap ring 160 positioned on the lower end of the threaded shaft 136 maintains coupling between the "T"-shaped draw bolt 132 and the roller die carrier 142.

The roller die carrier 142 further includes a pair of spaced, parallel walls coupled to and continuous with the end wall 143 at their respective upper ends. Positioned between the two side walls of the roller die carrier 142 are first and second roller dies 146, 148. The first and second roller dies 146, 148 are positioned on and maintained in position within the roller die carrier 142 by bearing pins **146*a* and 148*a*, respectively. Each of the bearing pins 146*a*, 148*a* is inserted through a pair of apertures in the roller die carrier 142 to permit the first and second roller dies 146, 148 to be rotationally displaced within the roller die carrier. As shown for the case of bearing pin 146*a* in FIG. 11, each of the aforementioned bearing pins is maintained in position within the roller die carrier 142 by means of a respective retaining pin 178. Alternatively, a single retaining pin may be inserted through the aligned apertures of the bearing pins 146*a* and 148*a* as well as into a slot in the outer surface of the roller die carrier 142** for maintaining it in position.

The lower portions of the pair of spaced, parallel C-shaped plates 140 and 141 form a die roller support structure 144 having two pairs of aligned, spaced apertures therein. A bearing pin **150*a* is positioned within one pair of spaced, aligned apertures, while another bearing pin 152*a* is inserted within a second pair of spaced, aligned apertures within the C-shaped plates 140 and 141. Bearing pin 150*a* is inserted through a third roller die 150, while bearing pin 152*a* is inserted through a fourth roller die 152. Each of the third and fourth roller dies 150, 152 is free to rotate within the manual crimper 130. Each of the bearing pins 146*a*, 148*a* is maintained in position so as to extend between the C-shaped plates 140 and 141 by means of a respective retainer pin 180 as shown in FIG. 11**.

A guide/alignment bar 166 is coupled to the roller die carrier 142 by conventional means such as a weldment 168. The guide/alignment bar 166 is in the general form of a planar, elongated plate which is disposed within a slot between the C-shaped plates 140 and 141 and further defined by hex nut 138 and guide sleeve 162. Rotational displacement of the "T"-shaped draw bolt 132 within the hex nut 138 causes upward or downward displacement of the roller die carrier 142 as well as the guide/alignment bar 166 disposed within the slot 164. The guide/alignment bar 166 includes a plurality of spaced gauge pin apertures **166*a*, 166*b* each of which is adapted to receive a gauge/stop pin 170. The alignment and spacing of the gauge pin apertures 166*a*, 166*b* defines the spacing between the first and second roller die combination and the third and fourth roller die combination. With a ferrule 154 disposed between the first and second roller combination and the third and fourth roller combination, the "T"-shaped draw bolt 134 is rotated so as to lower the roller die carrier 142 toward the roller die support structure 144 of the two C-shaped plates 140 and 141. The roller die carrier 142 is moved toward the roller die support structure 144 of the manual crimper 130 until the gauge/stop pin 170 inserted in one of the gauge pin apertures engages the upper edges of the pair of C-shaped plates 140 and 141. Contact between the gauge/stop pin 170 and the C-shaped plates 140 and 141 prevents further downward movement of the roller die carrier 142 and ensures proper spacing between the first and second roller combination and the third and fourth roller combination in accordance with the outer diameter of the ferrule 154. With the four aforementioned roller dies engaging the ferrule 154, the manual crimper 130** is rotationally displaced about the ferrule in order to provide crimping engagement of the ferrule with a hose end inserted therein.

Referring to FIG. 10, there is shown a partially cutaway side view of a gauge/stop pin 170 for use in the manual crimper 130. The gauge/stop pin 170 includes a head portion 172 at a first end thereof and a slot positioned adjacent to a second end thereof. Positioned within the slot is the combination of a coiled spring 174 and a ball 176 which serve to maintain the gauge/stop pin 170 in position within one of the aforementioned gauge pin apertures when inserted in the guide/alignment bar 166.

FIG. 11 illustrates the details of the relative position and orientation of the roller dies in the manual crimper 130. The first and second roller dies 146 and 148 are oriented to the left when viewed end-on as in FIG. 11. Similarly, the third and fourth roller dies, as shown for the case of roller die 150 in FIG. 11, are oriented to the right when viewed end-on. Thus, the two upper roller dies are aligned in a first direction, while the two lower roller dies are oriented in a second direction, where the first and second directions are offset relative to the plane of the roller die carrier 142 and the pair of aligned, parallel C-shaped plates 140 and 141. The rotational axes of the four roller dies are also at an angle relative to the longitudinal axis of the ferrule 154. The relative angled orientation of the roller dies, with the upper and lower roller die pairs facing in non-aligned orientations, allows the manual crimper 130 to trace over the surface of the ferrule 154 during crimping in a spiral path so that the ferrule is crimped along its length. By providing a crimping area of substantial width, more secure engagement is provided between the ferrule and a hose disposed therein. Each of the four roller dies further includes a spiral groove on the outer, circular surface thereof as shown for the case of the first roller die 146 with spiral groove **146*b* and the third roller die 150 with spiral groove 150*b***. It is the angled orientation of the rollers which causes the manual crimper to crimp the ferrule in a spiral path. The spiral grooves in the outer, peripheral surfaces of the roller dies further assists in spiral tracking of the manual crimper on the outer surface of the ferrule and, in combination with the beveled edges of the roller dies, reduces the possibility of splitting or cracking or otherwise damaging the ferrule. The aforementioned beveled edges of the roller dies also facilitate lateral displacement of the manual crimper along the length of the ferrule and provide more gradual and less abrupt bending and deformation of the ferrule thus reducing the likelihood of producing structural fatigue. The roller dies are preferably oriented at an angle of 4° relative to a plane perpendicular to the longitudinal axis of the ferrule and there are preferably six spiral grooves per inch in each of the roller dies.

Figure 12:
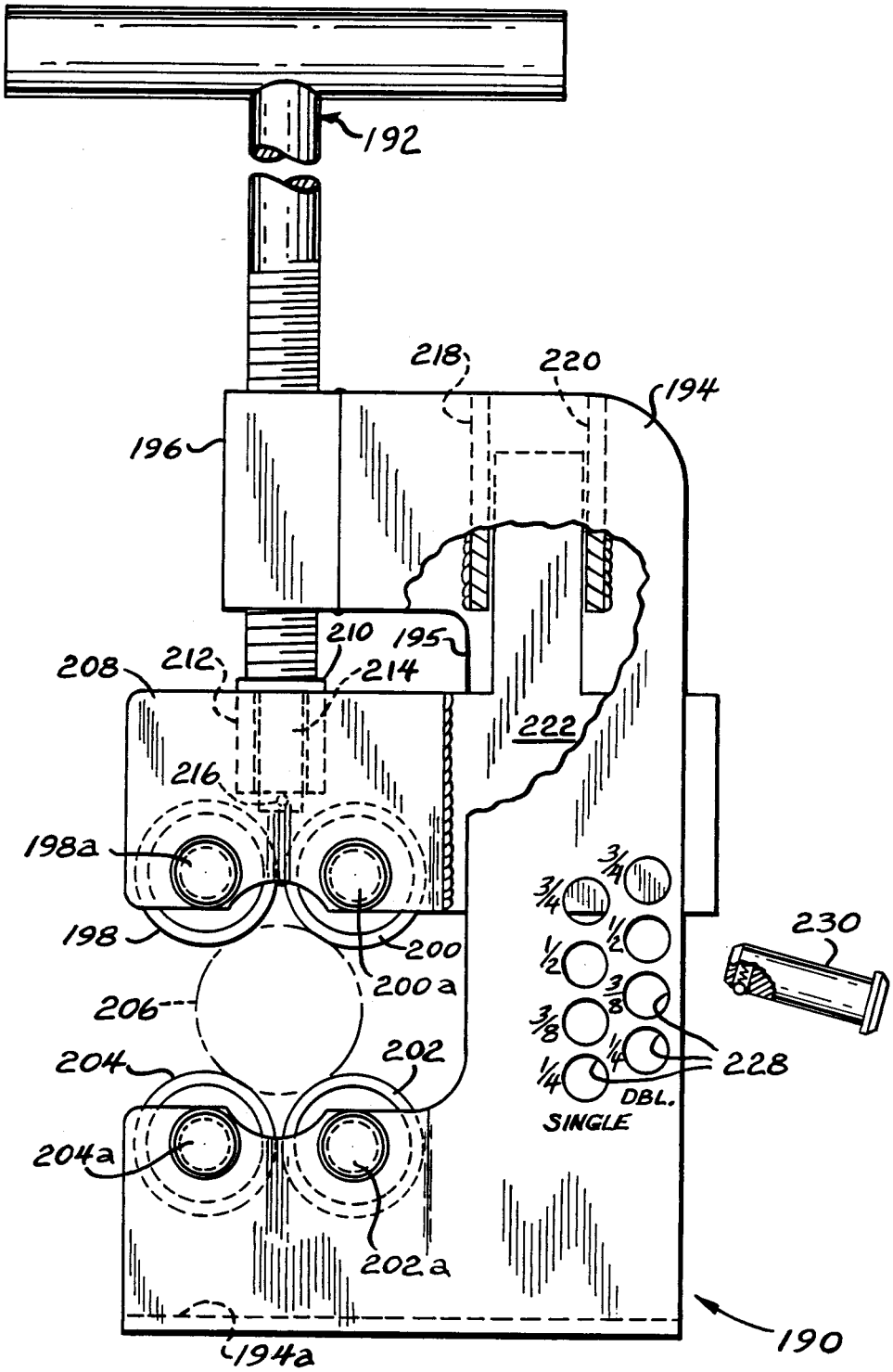
FIG. 12 is a planar view shown partially in phantom and partially cutaway of yet another embodiment of a manual hose end crimper in accordance with the present invention.

Referring to FIG. 12, there is shown a partially cutaway planar view of yet another embodiment of a manual crimper 190 in accordance with the present invention. The manual crimper 190 shown in FIG. 12 also includes a "T"-shaped draw bolt 92 inserted through and engaging a threaded coupling nut 196. The threaded coupling nut 196 is coupled to the upper edges of a pair of generally C-shaped plates 194 and 195 which are arranged in spaced, parallel alignment. The two C-shaped plates 194 and 195 are further coupled together by means of a pair of guide sleeves 218 and 220 which are coupled to each of the C-shaped plates by conventional means such as a weldment. The guide sleeves 218, 220 define a slot between the two C-shaped plates 194 and 195. The lower edges of each of the C-shaped plates 194 and 195 includes a cross member 194*a*, with the cross member of each of these plates coupled together such as by welding along the respective lengths thereof. The two C-shaped plates 194 and 195 are thus securely coupled together and maintained in relative spacing and position by various structural members disposed between and coupled to these plates. The lower end of the "T"-shaped draw bolt 192 includes a machined lower end portion 214 which is inserted within and coupled to a roller carrier 208 by means of a roller pin 216. A carrier bushing, or adapter, 212 inserted in the roller carrier 208 and a thrust washer, or bearing, 210 facilitate rotational displacement of the "T"-shaped draw bolt 192 within and relative to the roller carrier 208. Rotational displacement of the draw bolt 192 causes the roller carrier 208 to be displaced either upward or downward.

Inserted through spaced, aligned apertures in facing portions of the roller carrier 208 are a pair of bearing pins 198*a* and 200*a*. A first roller die 198 is positioned on bearing pin 198*a*, while a second roller die 200 is positioned on bearing pin 200*a*. It is in this manner that the first and second roller dies 198, 200 are mounted in the roller carrier 208 and free to rotate therein.

A second pair of bearing pins 202*a* and 204*a* are positioned within respective aligned, spaced apertures in a lower portion of the C-shaped plates 194 and 195. Bearing pin 202*a* is inserted through a third roller die 202, while bearing pin 204*a* is inserted through a fourth roller die 204. The third and fourth roller dies 202, 204 are thus coupled to and positioned between respective lower portions of the C-shaped plates 194 and 195 and are free to rotate therein. The four roller dies are adapted to receive a ferrule 206 therebetween for crimping the ferrule to a hose end.

Coupled to one end of the roller carrier 204 by conventional means such as a weldment and disposed between the two spaced, facing C-shaped plates 194 and 195 is a guide/alignment bar 222. The guide/alignment bar 222 is generally "T"-shaped and includes an upper portion disposed within the slot defined by the pair of guide sleeves 218 and 220 and the two C-shaped plates 194 and 195. The guide/alignment bar 222 is of the same width as the aforementioned roller dies to facilitate free movement of the roller carrier 208 when the threaded draw bar 192 is rotationally displaced. The right hand portion of the guide/alignment bar 222 which is disposed between the pair of spaced, parallel C-shaped plates 194 and 195 also maintains the roller carrier 208 in alignment as it is linearly displaced within the manual crimper 190.

Intermediate portions of each of the C-shaped plates 194 and 195 are provided with a plurality of spaced, aligned apertures 228. Each pair of aligned, spaced apertures 228 is adapted to receive a gauge/stop pin 230 inserted therein for limiting the downward displacement of the roller carrier 208 and guide/alignment bar 220 combination. The relative spacing and positioning of the apertures 228 is such that each aligned pair of apertures within the C-shaped plates 194 and 195 defines a given spacing between the first and second roller dies 198, 200 and the third and fourth roller dies 202, 204. In this manner, the manual crimper 190 may be adjusted to crimp various ferrules 206 having a range of outer diameters. As to the two embodiments of the invention shown in FIGS. 9 and 12, the embodiment of FIG. 9 is the preferred because the closer proximity of the axis of the threaded shaft of the "T"-shaped draw bolt to the guide/alignment bar produces a reduced torque in the manual crimper during tightening upon the ferrule and essentially eliminates misalignment problems among the various moving parts of the manual crimper.

Referring to FIG. 13 there is shown yet another embodiment of a manual crimper 240 in accordance with the present invention. As in the prior embodiments, the manual crimper 240 shown in FIG. 13 includes a "T"-shaped draw bolt 242 coupled to a movable roller carrier assembly 244. The manual crimper 240 further includes a pair of C-shaped plates 246 and 248 arranged in spaced, parallel alignment which are coupled at one end to a threaded coupling nut 268. The threaded shaft of the "T"-shaped draw bolt 242 is inserted in the threaded coupling nut 268 to permit the movable roller carrier assembly 244 to be moved toward and away from a lower portion of the C-shaped plates 246, 248 which also includes a pair of spaced roller dies therein. Movement of the movable roller carrier assembly 244 and two roller dies therein relative to a second pair of roller dies in the lower portion of the C-shaped plate assembly permits a ferrule 250 to be firmly grasped between the two pairs of roller dies for crimping. Coupled to the movable roller carrier assembly 244 is a guide/alignment bar 252 which includes a plurality of spaced apertures 262 therein. The guide/alignment bar 252 is positioned between the first and second C-shaped plates 246 and 248 and is further positioned between the threaded coupling nut 268 and a free roller pin 272 which is positioned between and coupled to the two C-shaped plates. The movable roller carrier assembly 244 and the guide/alignment bar 252 are coupled by conventional means such as a weldment. Each of the apertures 262 is adapted for receiving a wedge lock gauge pin 264 for establishing the spacing between the upper and lower pairs of roller dies in accordance with the outer diameter of the ferrule 250. A tether line 266 couples the wedge lock gauge pin 264 to the guide/alignment bar 252 to prevent the gauge pin from being lost.

A lower portion of the guide/alignment bar 252 is provided with an elongated, linear slot 254. Inserted in the slot and extending from the guide/alignment bar 252 is a coiled compression spring 256. Positioned within the compression spring 256 and aligned with the slot 254 in the guide/alignment bar 252 is a guide pin 258. One end of the guide pin 258 is provided with an aperture through which a retainer pin 260 is inserted. Opposing ends of the retainer pin 260 are coupled to facing, inner portions of the first and second C-shaped plates 246, 248 for securely mounting the guide pin 258 within the manual crimper 240. The opposing end of the guide pin 258 is free to move within and along the slot 254 within the guide/alignment bar 252. The retainer pin 260 not only serves to attach one end of the guide pin 258 to the first and second C-shaped plates 246, 248, but also serves as an end stop for one end of the coiled compression spring 256. The coiled compression spring 256 urges the combination of the guide/alignment bar 252 and the movable roller carrier assembly 244 to the retracted, or upward, position to eliminate the requirement for secure coupling between the movable roller carrier assembly and the threaded shaft portion of the "T"-shaped draw bolt 242. The arrangement of FIG. 13 thus eliminates the requirement for a rotatable connection between the "T"-shaped draw bolt 242 and the movable roller carrier assembly 244. The lower end of the "T"-shaped draw bolt 242 is provided with a rounded bearing surface with a corresponding recess 270 provided in the upper surface of the movable roller carrier assembly 244 to receive the distal end of the "T"-shaped draw bolt. The free roller pin 272 securely maintains the guide/alignment bar 252 in contact with the threaded coupling nut 268 to ensure precise vertical movement of the guide/alignment bar and movable roller carrier assembly combination.

Referring to FIG. 14 there is shown an end-on view of a lower corner of the manual crimper 240 shown in FIG. 13. The lower, adjacent corners of the first and second C-shaped plates 246, 248 are spaced approximately ½" apart, with each corner bent 90° and ¼" toward the opposing side of the other plate. A weldment 274 joins the adjacent corners of the first and second C-shaped plates 246, 248 to increase the strength and rigidity of the manual crimper 240. One of the advantages of the embodiment shown in FIG. 13 over the previously described embodiments is that the guide/alignment block and the movable roller carrier assembly could be cast as a single piece as could the first and second C-shaped plates 246 and 248.

The various embodiments of manual crimper of the present invention are used in the following manner in a preferred embodiment. After the facing pairs of rollers are positioned in spaced relation in accordance with the outer diameter of the ferrule to be crimped using either the bushing-like gauge blocks of the embodiment of FIG. 1 or the gauge/stop pins of the other embodiments, the manual crimping apparatus of the present invention is rotationally displaced about the ferrule 4–5 revolutions. The direction of rotation of the crimper is then reversed so that it retraces its original track. After the crimper is returned to its original position, the threaded "T"-shaped draw bolt is tightened ¼ of a turn to reduce the effective swaging diameter by approximately 0.013 of an inch if tighter crimping of the ferrule is desired. This metal spinning process generates a certain amount of heat which further enhances the ductility of the metal ferrule and facilitates crimping of the ferrule without producing cracks or other unwanted deformations therein. The roller dies are offset by approximately 4° relative to the direction of rotation of the manual crimper about the ferrule. With an approximately 4° angle between the axis of rotation of each of the roller dies and the longitudinal axis of the ferrule, six crimping grooves per inch are produced in the ferrule without producing any indentations or sharp edges on the ferrule's outer surface. The flat surface on the outer periphery of the roller dies between the spiral grooves therein smoothes the ferrule as the roller dies traverse the ferrule in a spiral tract. The spiral grooves in each of the roller dies further assist this spiral displacement of the manual crimper relative to the ferrule. The depth of the spiral groove in each of the roller dies is preferably greater than the smallest diameter of the roller die so as to provide the facing outer edges of the roller with an approximately 12° taper. The tapered edges of the roller dies further facilitate gradual crimping of the ferrule and reduces the likelihood of causing structural fatigue or cracking in the ferrule. The threaded shaft of the "T"-shaped draw bolt is preferably ½" in diameter and has 20 threads per inch. The manual crimper of the present invention is preferably capable of accommodating ferrules having an outer diameter ranging from ¼" to ¾".

There has thus been shown a manual hose end crimper for tightly and securely crimping a rigid, tube-like ferrule on the end of a hose. The manual crimper includes first and second pairs of roller dies which are movable toward and away from each other so as to accommodate a range of ferrule outer diameters. Each of the roller dies is angled relative to a plane passing through the ferrule and oriented perpendicular to its longitudinal axis so that as the manual crimper is rotated about the ferrule, the roller dies form a spiral track about the ferrule to provide crimping of the ferrule along its length. The length of the crimp may be selected as desired to allow the operator of the crimper to provide a wide, virtually continuous range of crimping contact and mutual engagement between the ferrule and hose end. The several embodiments of the manual crimper allow for adjustments depending upon the outer diameter of the ferrule, which adjustments are easily accomplished by means of a bushing-like spacer element or a gauge/stop pin inserted in one of a plurality of spaced, aligned apertures in the crimper. The manual crimper is easily used, inexpensive, portable, and permits the user to select the extent of crimping between the ferrule and hose end.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Manually operated apparatus for crimping a ferrule onto the end of a hose, said apparatus comprising:

first and second roller means;

first and second carrier means for engaging and supporting said first and second roller means, respectively, in spaced relation; and manual control means coupled to said first and second carrier means for adjusting the spacing between said first and second carrier means and for positioning said first and second roller means in tight fitting contact with a ferrule disposed therebetween;

wherein said roller means are oriented at an angle relative to a plane perpendicular to a longitudinal axis of the ferrule such that rotation of the crimping apparatus about the ferrule in a direction generally perpendicular to the ferrule's longitudinal axis causes the roller means to follow a spiral path along the length of the ferrule in crimping the ferrule to the hose end.

2. The apparatus of claim 1 wherein said first and second roller means are each comprised of a plurality of roller dies rotationally coupled to said first and second carrier means, respectively.

3. The apparatus of claim 2 wherein said first and second carrier means each include a pair of spaced, generally flat plates between which are disposed said roller dies.

4. The apparatus of claim 3 further comprising a plurality of bearing pins coupled to and disposed between said flat plates, wherein a respective roller die is disposed on each of said bearing pins.

5. The apparatus of claim 2 wherein each of said roller dies includes a spiral groove on its curved periphery.

6. The apparatus of claim 5 wherein each of said roller dies includes six spiral grooves per inch over the width of its curved periphery.

7. The apparatus of claim 2 wherein each of said roller dies is oriented at an angle of 4° relative to the longitudinal axis of the ferrule.

8. The apparatus of claim 1 wherein said first and second carriers are movably coupled together in a sliding manner.

9. The apparatus of claim 1 wherein said first and second carrier means are pivotally coupled together on a first side of said roller means and are coupled together by said manual control means on a second side of said roller means.

10. The apparatus of claim 9 further comprising spacer/gauge means disposed between and in contact with said first and second carrier means on the second side of said roller means for proper spacing between said first and second roller means in accordance with an outer diameter of the ferrule.

11. The apparatus of claim 10 further comprising a plurality of spacer/gauge means selectively insertable between said first and second carrier means in accordance with an outer diameter of the ferrule.

12. The apparatus of claim 1 wherein said manual control means includes an elongated threaded shaft having a manual gripping portion at one end thereof and a second end coupled to said second carrier means.

13. The apparatus of claim 12 wherein said threaded shaft extends through said first carrier means.

14. The apparatus of claim 13 further comprising spacer/gauge means disposed between and in contact with said first and second carrier means and through which the threaded shaft of said manual control means is inserted.

15. The apparatus of claim 14 wherein said spacer/gauge means is a bushing having an aperture therein through which said threaded shaft is inserted.

16. The apparatus of claim 15 further comprising a plurality of spacer/gauge means disposed along the length of said threaded shaft and wherein one of said spacer/gauge means is disposed between and in contact with said first and second carrier means.

17. The apparatus of claim 1 further comprising engaging means for engaging and securely maintaining the ferrule in a fixed orientation and position during crimping.

18. The apparatus of claim 17 wherein said engaging means includes first and second engaging members movably coupled together and having respective concave edges arranged in facing relation and adapted to engage opposed portions of the ferrule.

19. The apparatus of claim 1 wherein said first and second roller means are oriented at opposed relative angles with a plane perpendicular to a longitudinal axis of the ferrule.

20. The apparatus of claim 1 wherein said manual control means includes an elongated threaded shaft having a gripping portion at one end thereof and is coupled to said first carrier means at a second end thereof.

21. The apparatus of claim 20 further comprising pivotal coupling means for coupling said threaded shaft to said first carrier means.

22. The apparatus of claim 1 wherein said first and second carrier means are coupled together and are movable in a linear manner relative to one another.

23. The apparatus of claim 22 wherein said first carrier means includes guide/alignment means coupled to and engaging said second carrier means in a sliding manner to ensure linear relative displacement between said first and second carrier means.

24. The apparatus of claim 23 wherein said guide/alignment means includes a plurality of spaced apertures each adapted to receive a gauge/stop pin for controlling the spacing between said first and second roller means in accordance with an outer diameter of the ferrule.

25. The apparatus of claim 24 further comprising biasing means for urging said first and second carrier means away from one another.

* * * * *